US007046212B2

(12) United States Patent
Tai et al.

(10) Patent No.: US 7,046,212 B2
(45) Date of Patent: May 16, 2006

(54) EXTERNAL ANTENNA

(75) Inventors: Lung-Sheng Tai, Tu-chen (TW); Zhen-Da Hung, Tu-chen (TW); Hsien-Chu Lin, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/873,890

(22) Filed: Jun. 21, 2004

(65) Prior Publication Data

US 2004/0257299 A1 Dec. 23, 2004

(30) Foreign Application Priority Data

Jun. 20, 2003 (TW) ..... 92211306 U

(51) Int. Cl.
*H01Q 3/02* (2006.01)
*H01Q 1/42* (2006.01)

(52) U.S. Cl. ..... 343/882; 343/872

(58) Field of Classification Search ..... 343/882, 343/869, 880, 711, 872
See application file for complete search history.

(56) References Cited

U.S. PATENT DOCUMENTS 5,032,846 A * 7/1991 Chang ..... 343/882
5,526,005 A * 6/1996 Koo ..... 343/702
5,973,645 A * 10/1999 Zigler et al. ..... 343/702
6,215,445 B1 * 4/2001 Chang ..... 343/702
6,310,586 B1 * 10/2001 Takahashi et al. ..... 343/872
6,486,842 B1 * 11/2002 Wang ..... 343/715
6,518,928 B1 * 2/2003 Sheu ..... 343/702
6,710,747 B1 * 3/2004 Chang ..... 343/702
6,853,353 B1 * 2/2005 Wang et al. ..... 343/901
2004/0051670 A1 * 3/2004 Sato ..... 343/702
2005/0259023 A1 * 11/2005 Wang ..... 343/764

* cited by examiner

*Primary Examiner*—Trinh V Dinh
*Assistant Examiner*—Angela M Lie
(74) *Attorney, Agent, or Firm*—Wei Te Chung

(57) ABSTRACT

An external antenna (100) for a wireless communication device includes a dielectric base (1), a rotatable portion (2) received in the base, a connecting portion (3) connected with the rotatable portion and an antenna element (4) connected with the connecting portion. The dielectric base defines a bore (10) and a groove (12) therein. The rotatable portion includes an upper portion (21) and a block (23) extending from the rotatable portion and slidably engaging in the groove for limiting a rotational movement of the rotatable portion relative to the dielectric base. The connecting portion has an engaging portion (30) connected with the upper portion of the rotatable portion.

7 Claims, 5 Drawing Sheets

EXTERNAL ANTENNA

BACKGROUND OF THE INVENTION

1. Field of the Invention

The present invention relates in general to antenna structures, and in particular to an external antenna structure that can be detached from a wireless communication device.

2. Description of the Prior Art

External antennas are used to wireless communication devices to receive and transmit radio signals for increased efficiency in the communication. Most antennas are generally fixed to the housing of a wireless communication device without movement. These fixed antennas have a limited receiving and transmitting degree of the radio signals and suffer from the risk of being broken or damaged during the life of the wireless communication device. Fixing or replacing the permanent antenna's connection often requires a costly repair and removal of the wireless communication device from service for a period of time.

U.S. Pat. No. 6,518,928 discloses a conventional antenna device having a rotation limited structure. The antenna device includes a housing secured to an electric facility, a seat rotatably received in the housing, and an antenna element rotatably secured to the seat with a pivot pin. The housing includes a curved recess formed in the upper portion. The seat includes a projection protruding radially and slidably engaged in the curved recess of the housing, for limiting the projection to slide along the curved recess of the housing and for limiting the rotational movement of the seat relative to the housing and for preventing electric wires from being twisted. However, the antenna device is secured to a fixed place of the electric facility without movement, which is difficult to adjust a suitable receiving and transmitting direction/location and disassemble the antenna from the electric facility.

Hence, an improved antenna is desired to overcome the above-mentioned disadvantages of the prior art.

BRIEF SUMMARY OF THE INVENTION

A primary object of the present invention is to provide an external antenna with a movable base structure for allowing the external antenna to achieve a suitable receiving and transmitting direction/location.

Another object of the present invention is to provide an external antenna with a dielectric base detached from a wireless communication device for facilitating disassembly of the external antenna from the wireless communication device.

An external antenna for a wireless communication device includes a dielectric base detached from the wireless communication device, a rotatable portion received in the base, a connecting portion connected with the rotatable portion and an antenna element connected with the connecting portion. The dielectric base defines a bore and a groove therein. The rotatable portion received in the bore includes an upper portion and a block slidably engaging in the groove for limiting a rotational movement of the rotatable portion relative to the dielectric base. The connecting portion has an engaging portion connected with the upper portion of the rotatable portion by a pair of pivot pins.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
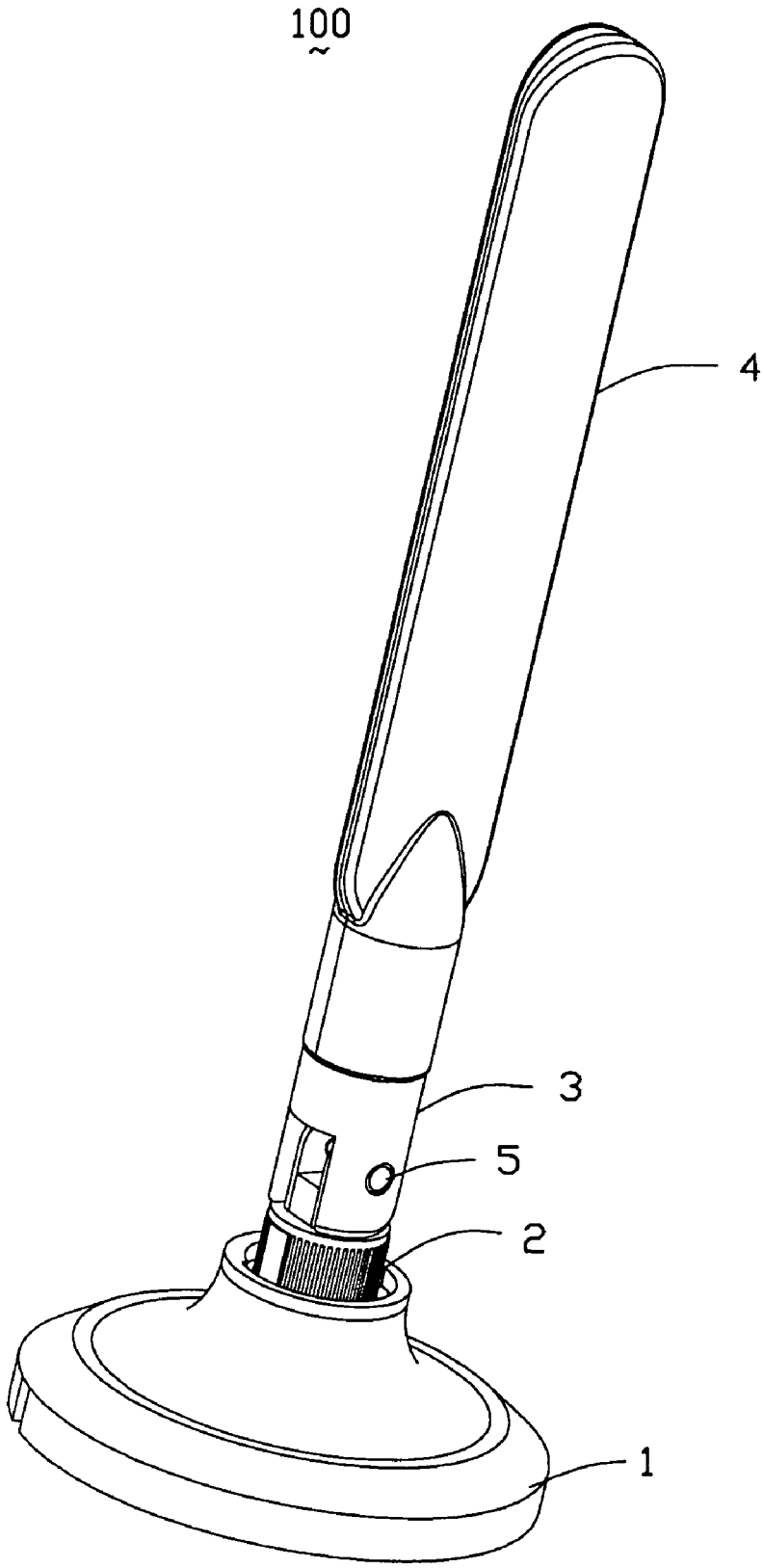
FIG. 1 is a perspective view of an external antenna in accordance with the present invention.

Referring to FIG. 1, an external antenna 100 in accordance with a preferred embodiment of the present invention for a wireless communication device (not shown) comprises a dielectric base 1, a rotatable portion 2 partially received in the dielectric base 1, a connecting portion 3 connected with the rotatable portion 2 and an antenna element 4 connected with the connecting portion 3.

Figure 2:
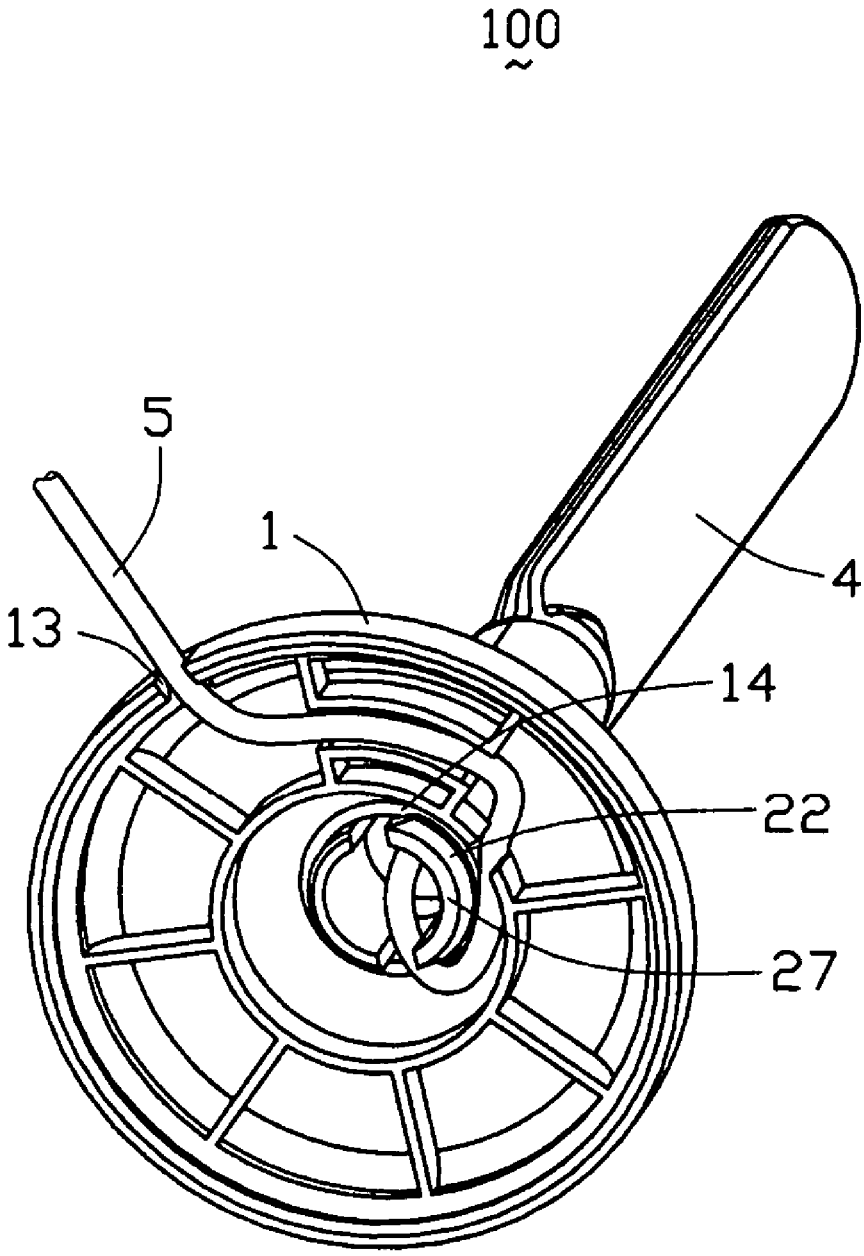
FIG. 2 is another perspective view of the external antenna of FIG. 1, and a cable.
Figure 3:
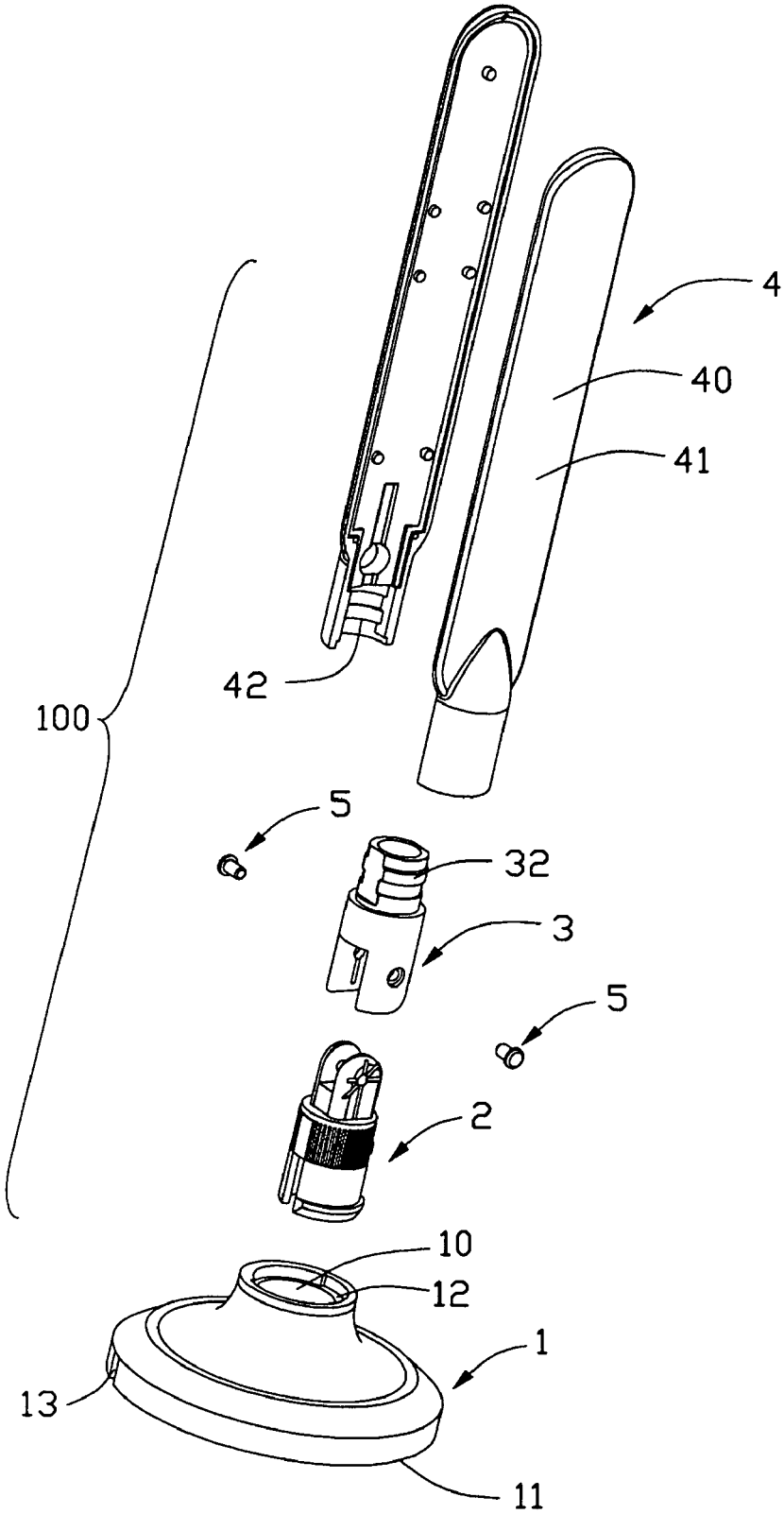
FIG. 3 is an exploded view of the external antenna of FIG. 1.

Referring to FIGS. 2 and 3, the dielectric base 1 detached from the wireless communication device has a disk-shaped and includes a bore 10 defined therethrough and a supporting portion 11. A groove 12 is defined in an inner wall (not labeled) of the dielectric base 1 communicating with the bore 10. A notch 13 is defined in the supporting portion 11 for receiving a cable 5. A latch portion 14 is formed on the bottom portion of the supporting portion 11.

Figure 4:
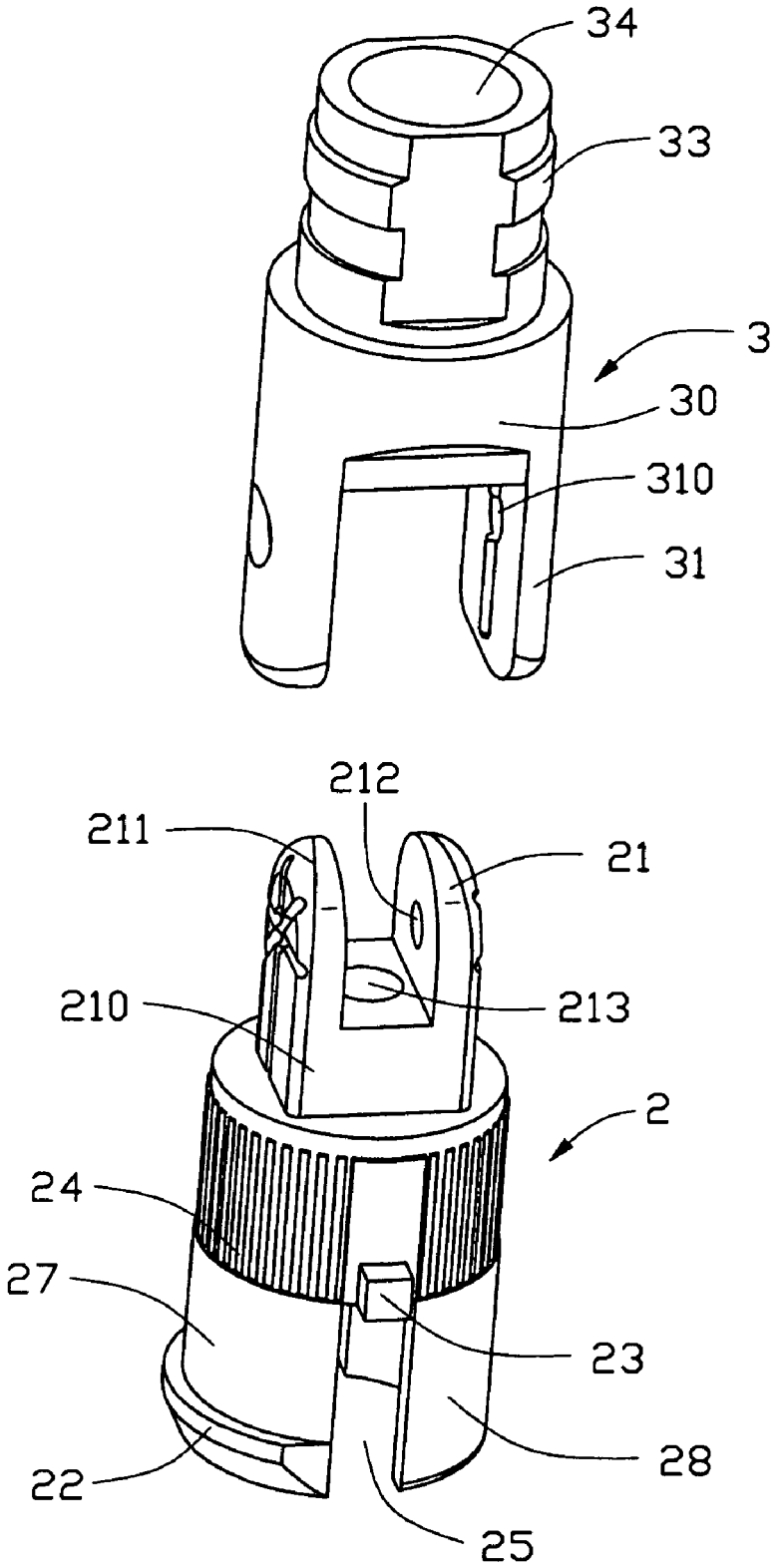
FIG. 4 is a partial, exploded view of the external antenna of FIG. 1, including a rotatable portion and a connecting portion.
Figure 5:
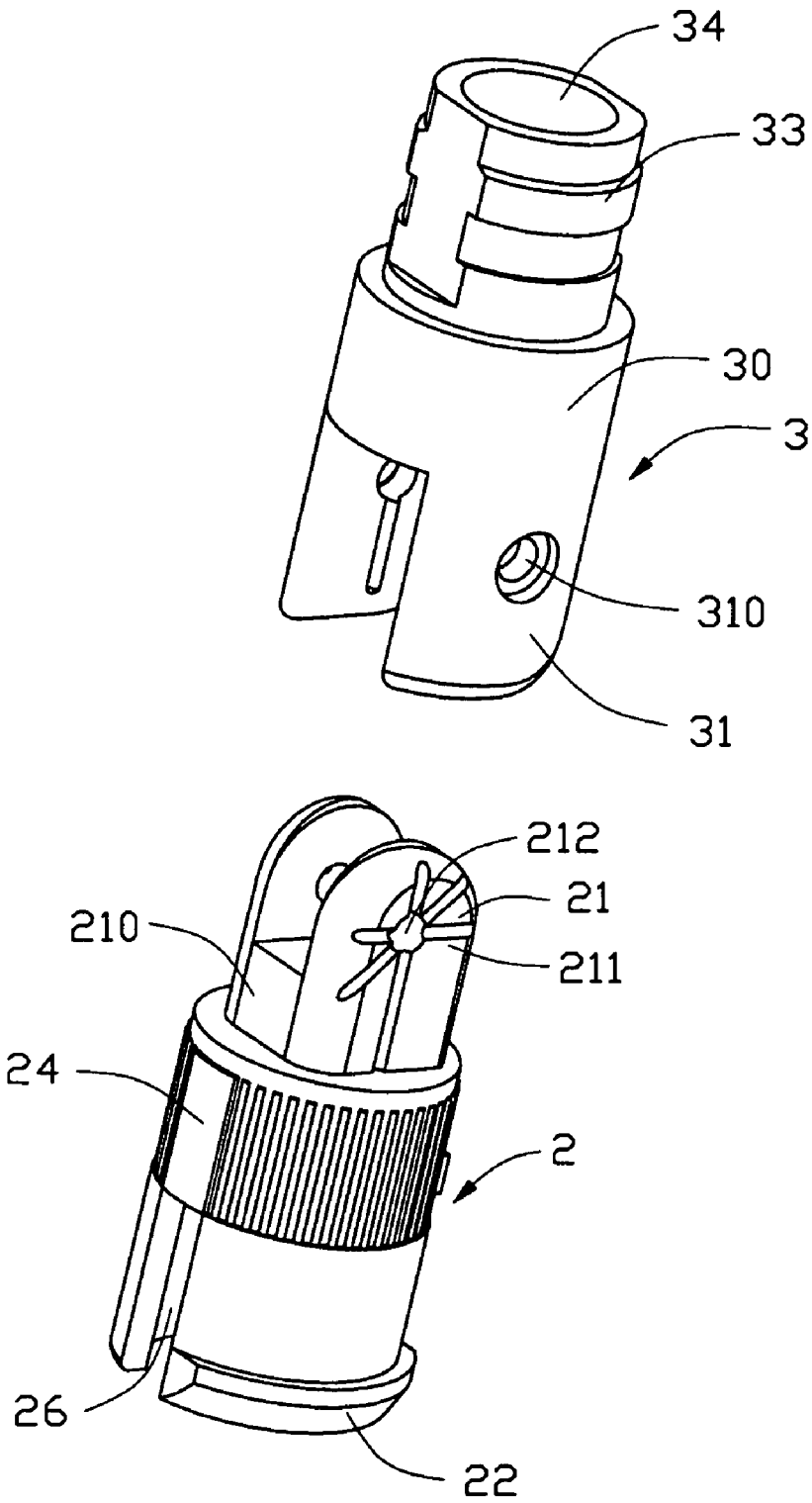
FIG. 5 is another exploded view of the rotatable portion and the connecting portion of FIG. 4.

Referring to FIGS. 4 and 5, the rotatable portion 2 includes an upper portion 21 and a cylinder portion 24 rotatably engaged in the bore 10 of the dielectric base 1. The cylinder portion 24 includes a first and second openings 25, 26 defined therein for forming a first and second spring legs 27, 28. The first spring leg 27 defines a flange 22 extended radially therefrom for engaging with the latch portion 14 of the dielectric base 1. A block 23 is disposed above the first opening 25 and protruding outwardly from the cylinder portion 24. The upper portion 21 includes a rectangular portion 210 and a pair of intervening arms 211 extending from two opposite sides of the rectangular portion 210. Each intervening arm 211 defines a first circular hole 212. A first through hole 213 is defined in a middle portion of the rectangular portion 210 for receiving the cable 5.

The connecting portion 3 includes an engaging portion 30 engaging with the pair of intervening arms 211, a thread 33 and a second through hole 34 defining through the connecting portion 3 for receiving the cable 5. The engaging portion 30 includes a pair of engaging arms 31 defines a pair of second circular holes 310 respectively corresponding to each first circular hole 212.

The antenna element 4 includes a pair of arms 40. Each arm 40 has a planar cover 41 and a mating portion 42 for rotatably engaging with the thread 33 of the connecting portion 3. An antenna component (not shown) is received in the antenna element 4 for receiving and transmitting radio signals.

Referring to FIGS. 2 to 5, in assembly, when the rotatable portion 2 is received in the base 1, the flange 22 is retained by the latch portion 14 for rotatably securing the rotatable portion 2 to the dielectric base 1. The block 23 is received in the groove 12 for slidably engaging in the groove 12 for limiting a rotational movement of the rotatable portion 2 relative to the dielectric base 1. The connecting portion 3 is connected with the rotatable portion 2 by a pair of pins 5 engaging with each first circular hole 213 and each second circular hole 310. The engaging portion 31 and the upper portion 21 together constitute a pivot means (not labeled). The antenna element 4 connected with the connecting portion 3 by the mating portions 42 rotatably engaging with the thread 33.

In use, the pivot means and the rotatable portion 2 can change the receiving or transmitting direction of the external antenna 100 to achieve a optimal receiving or transmitting efficiency. Furthermore, the dielectric base 1 of the external antenna 100 detached from the wireless communication device can be disposed on a plane of the wireless communication device or a desk and moved in a range of the length of the cable 5, to achieve better receiving or transmitting efficiency and facilitate disassembly of the external antenna 100 with the wireless communication device.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An external antenna adapted for a wireless communication device, comprising:

a dielectric base defining a bore and a groove therein;

a rotatable portion being received in the bore and including an upper portion and a block slidably engaging in the groove for limiting a rotational movement of the rotatable portion relative to the dielectric base;

a connecting portion having an engaging portion connected with the upper portion of the rotatable portion; and an antenna element connected with the connecting portion, wherein the connecting portion has a thread; and wherein the antenna element includes a pair of arms, each arm having a mating portion engaging with the thread and a planar cover, and an antenna component received in the cover.

2. The external antenna as claimed in claim 1, wherein the dielectric base has a notch for receiving a cable.

3. The external antenna as claimed in claim 1, wherein the upper portion includes a rectangular portion and a pair of intervening arms extending from the rectangular portion, each intervening arm defining a first circular hole.

4. The external antenna as claimed in claim 3, wherein the engaging portion includes a pair of engaging arms, each engaging arm defining a second circular hole aligned with a corresponding first circular hole.

5. The external antenna as claimed in claim 4, wherein the engaging arms and intervening arms are connected with each other by a pair of pivot pins respectively engaging with each first circular hole and each second circular hole.

6. The external antenna as claimed in claim 1, wherein the base has a latch portion, and the rotatable portion has a flange engaging with the latch portion.

7. An external antenna adapted for a wireless communication device, comprising:

an enlarged dielectric base defining a bore extending in an axial direction in a center portion and a notch extending in a radial direction perpendicular to said axial direction in a periphery portion;

a rotatable portion being received in the bore for a rotational movement of the rotatable portion relative to the dielectric base about said axial direction;

a connecting portion lined to said rotatable portion, said connecting portion being rotatable relative to said rotatable portion about an axis which is perpendicular to said axial direction; and an antenna element connected with the connecting portion.

* * * * *